United States Patent [19]

Tassi et al.

[11] 4,313,288

[45] Feb. 2, 1982

[54] MACHINE FOR PACKAGING VARIOUS ARTICLES BETWEEN TWO JUXTAPOSED PLASTICS MATERIAL SHEETS

[75] Inventors: Lamberto Tassi; Gianni Tosarelli; Aris Ballestrazzi, all of Vignola, Italy

[73] Assignee: Sitma - Societa Italiana Macchine Automatiche S.p.A., Spilamberto, Italy

[21] Appl. No.: 47,692

[22] Filed: Jun. 12, 1979

[30] Foreign Application Priority Data

Jun. 13, 1978 [IT] Italy ..... 24510 A/78

[51] Int. Cl.[3] ..... B65B 57/12; B65B 9/02

[52] U.S. Cl. ..... 53/74; 53/553; 53/229

[58] Field of Search ..... 53/229, 553, 389, 74, 53/230, 231, 228, 586

[56] References Cited

U.S. PATENT DOCUMENTS

| | | | |
|---|---|---|---|
| 3,061,989 | 11/1962 | Newell | 53/389 |
| 3,248,849 | 5/1966 | Hanson | 53/586 X |
| 3,283,473 | 11/1966 | Cohen | 53/553 |
| 3,503,175 | 3/1970 | Marasso | 53/553 |
| 3,866,389 | 2/1975 | Elsner | 53/553 |
| 3,990,215 | 11/1976 | Elsner | 53/553 |
| 4,011,708 | 3/1977 | Brown, Jr. | 53/384 |
| 4,033,092 | 7/1977 | Yetter | 53/131 |
| 4,047,359 | 9/1977 | Gronebaum | 53/553 |
| 4,069,643 | 1/1978 | Young et al. | 53/86 X |

FOREIGN PATENT DOCUMENTS

| | | | |
|---|---|---|---|
| 2422000 | 12/1974 | Fed. Rep. of Germany | 53/553 |
| 2548786 | 12/1977 | Fed. Rep. of Germany | 53/553 |

*Primary Examiner*—John Sipos

*Attorney, Agent, or Firm*—Cushman, Darby & Cushman

[57] ABSTRACT

A machine for packaging sundry articles between two weldable plastics material sheets is disclosed, in which provision is made for the formation of a top sheet loop to cope with different tallnesses of the articles as they are being packaged and sealed between the plastics sheet: undue sheet tensions are prevented as well as undue slackening of the sheet.

Waste of plastics material is also efficiently done away with.

1 Claim, 7 Drawing Figures

MACHINE FOR PACKAGING VARIOUS ARTICLES BETWEEN TWO JUXTAPOSED PLASTICS MATERIAL SHEETS

This invention relates to a machine for packaging various articles between two juxtaposed plastics material sheets.

Machines are known, which package articles of various kinds within plastics material casings, by severing and transversally welding, between an article and the next, two juxtaposed sheets which are fed one above and the other below the articles to be packaged. The bottom sheet is usually laid on a conveyor belt which defines a horizontally running working path, along which a carriage is reciprocable, which carries a welding unit to be depressed, between an article and the next, towards a corresponding counterwelding unit carried by the same carriage. A machine of this kind has been disclosed, for example, in the Italian Patent Specification No. 858 011.

In a machine of the kind referred to above, the major problem is the fact that the machine is incapable of performing in an uniformly satisfactory manner the packaging of articles of different tallnesses. As a matter of fact it occurs that, once that the feed of the top sheet has been adjusted for an article having a certain tallness, the wrapping of a shorter article originates a waste of sheet material, while, conversely, to wrap an article having a higher tallness originates an undesirable tightening of the top sheet, the result being a reduction of the resistance of the welded seam and a possible scattering of the assembly of articles which often is contained in a single package.

An object of the present invention is to provide a packaging machine of the kind using juxtaposed sheets and which lends itself equally well for wrapping articles of different tallnesses, the tallness being variable from an article to any other.

According to the invention, this object is achieved by a packaging machine which comprises a conveyor belt movable along a working path having a horizontal orientation, a bottom sheet fed on said conveyor belt along said working path to receive the articles to be packaged, a top sheet fed above the articles to be packaged along said working path and a welding unit positioned above said top sheet and capable of being depressed until engaging a counterwelding unit positioned under said bottom sheet to effect a double transversal welding of the two sheets, an intermediate severing action being carried out therebetween in the space interval between an article and its next, said machine being characterized in that for the feed of the top sheet a feeding unit is provided which includes a payoff drum which is controllably actuable, a feeding roller which can controllably be actuated and has, associated therewith, a pressure roller which can be withdrawn from the feeding roller as the welding unit falls towards the counterwelding unit, and a succession of idle rollers inserted between said drum and said feeding roller to provide a succession of alternate sheet loops, at least one of such idle rollers being controllably shiftable near the adjoining rollers in order to define therebetween a sheet shank which can freely be drawn by the welding unit as the latter falls towards the counterwelding unit.

Stated another way, the machine according to the invention provides to that the controlled shift of one of the idle rollers which engage the top sheet, in combination with the controlled withdrawal of the pressure rollers of the feeding drum, supplies the welding unit with a free sheet shank that the welding unit is capable of using, from time to time, to such an extent as automatically determined consistently with the tallness of the article behind which the welding is being effected. Thus, neither waste of material nor undue tensions occur in the top sheet, the latter being always drawn to the correct extent without suffering from any undesirable drag.

The foregoing and other features of the present invention will become apparent from the ensuing description in detail of a possible practical embodiment of the machine, shown by way of example in the accompanying drawings, wherein.

Figure 1:
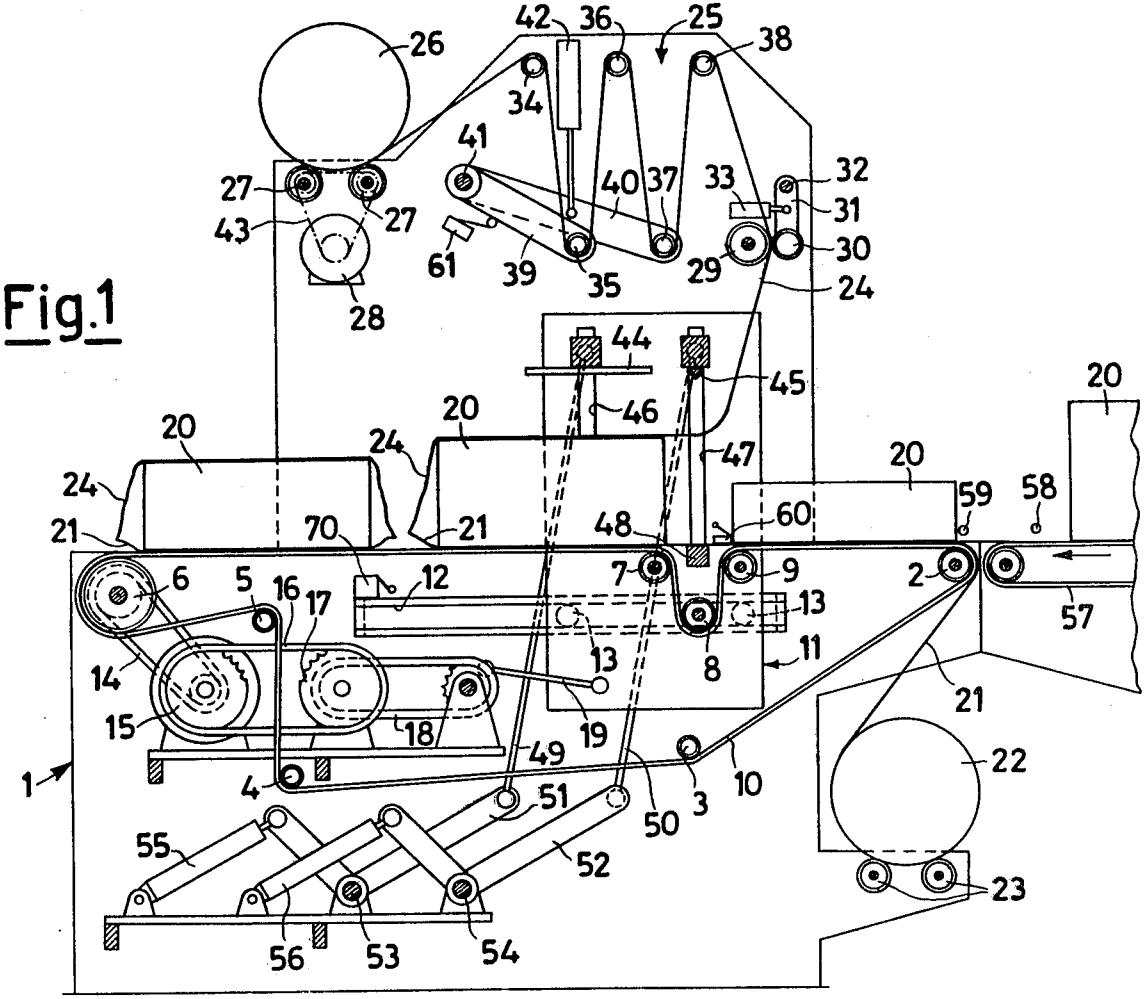
FIG. 1 is a diagrammatical lengthwise crosssectional view of the machine according to the invention, as viewed in the position immediately before the start of a welding operation of the two juxtaposed sheets.
Figure 2:
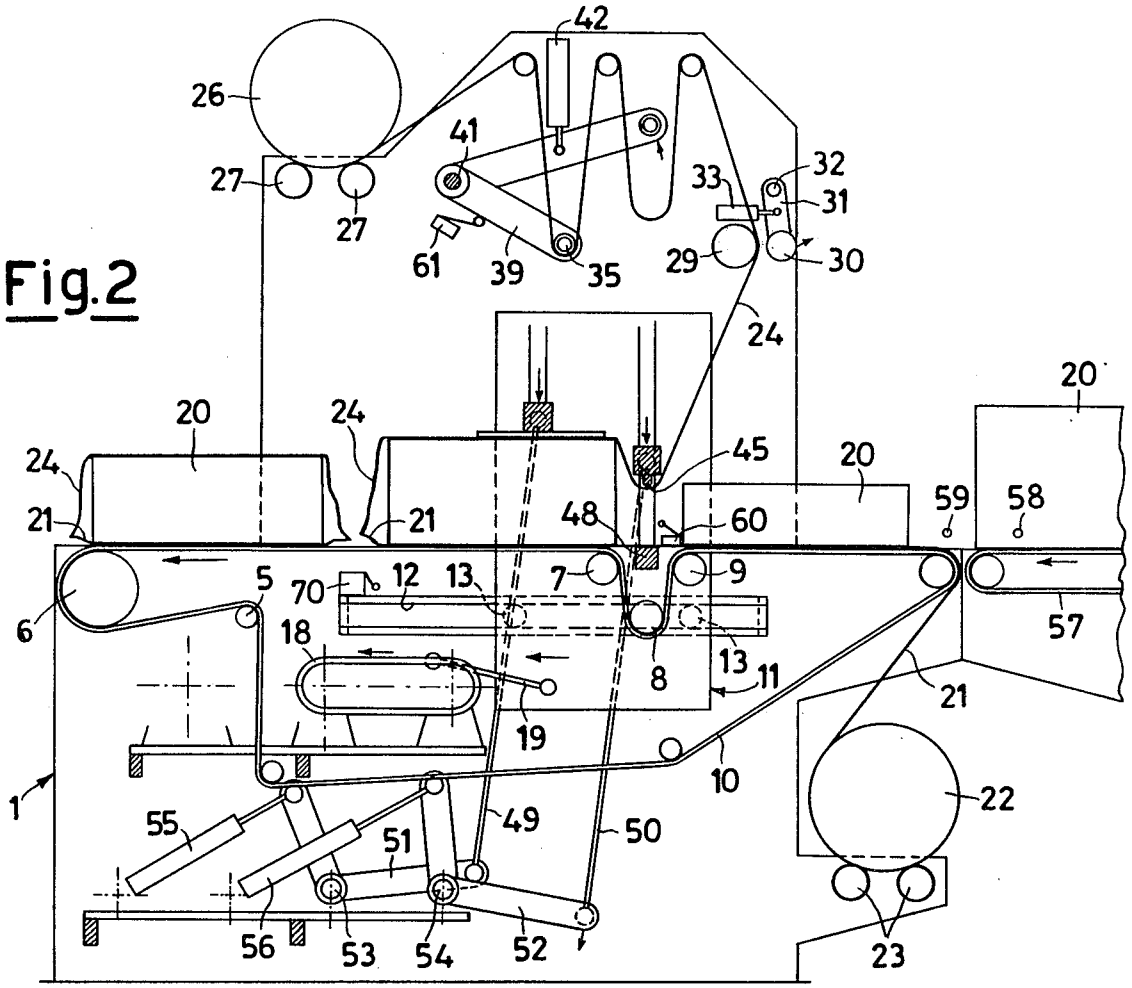
FIGS. 2 to 4 are similar views of the same machine in subsequent instants of time of its operation, and, FIGS. 5 to 7 are diagrammatical views of the machine inlet portion in different working stages.
Figure 3:
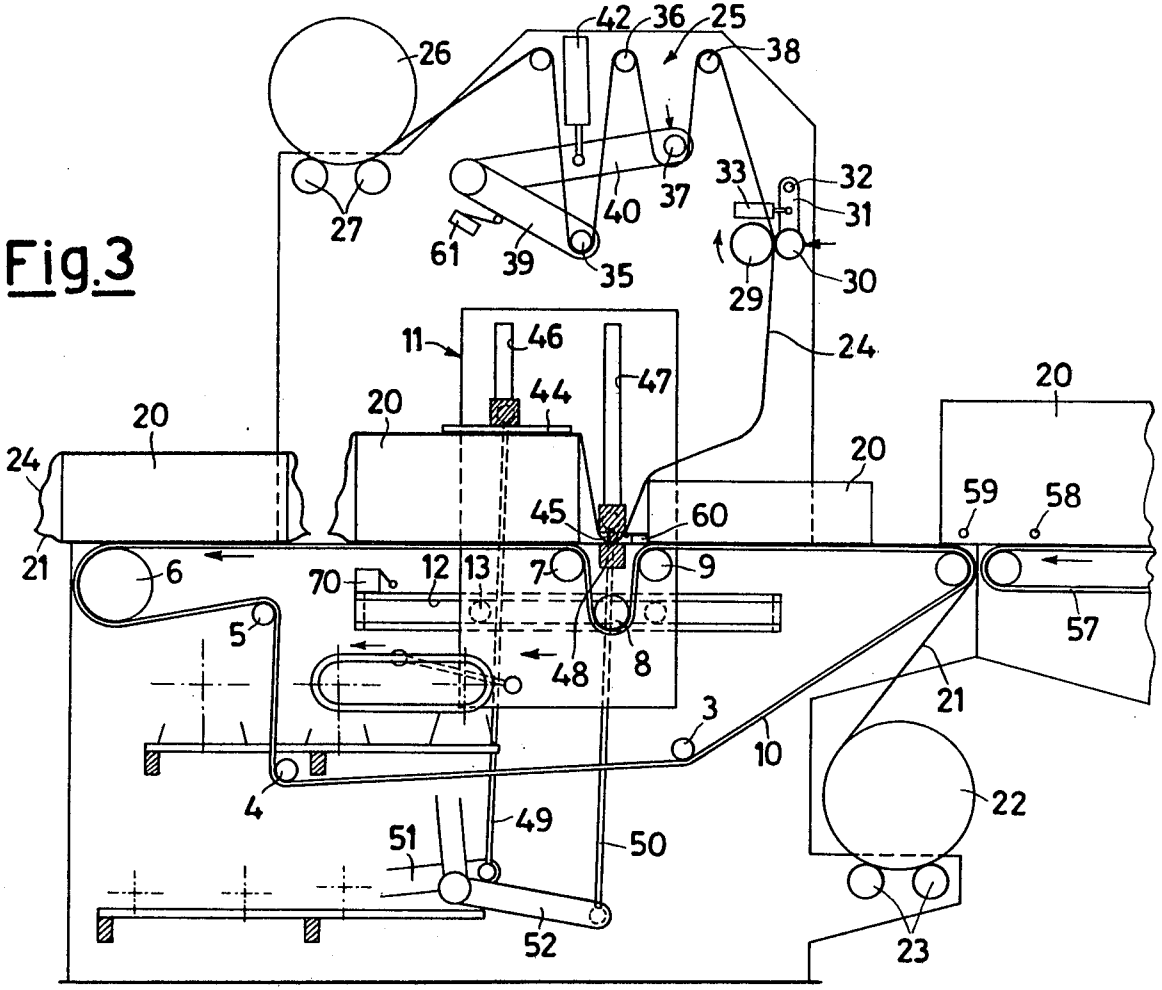

The machine shown in the drawings comprises a bedplate 1, which supports for rotation a set of guiding rollers 2–6 which engage a conveyor belt 10 arranged in a closed loop layout.

As depicted in FIGS. 1 to 4 inclusive, the conveyor belt 10 has a horizontal upper lap which provides the working path of the machine and which displays a short U-shaped scroll in coaction relationship with a set of three rollers, 7, 8 and 9, supported for rotation on a carriage 11: the latter can run on a couple of horizontal guideways 12 with the intermediary of wheels 13.

The conveyor belt 10 is actuated by a roller 6 and a timing belt 14 of a motor 15. The motor 15 is also enabled to command a reciprocation of the carriage 11 along the guideways 12 by means of another timing belt 16, a shiftable brake-and-clutch unit 17, a further timing belt 18 and a pitman 19.

Above the conveyor belt 10, but below the articles to be packaged, generally shown at 20, a bottom sheet 21 is fed, which is freely paid off from a drum 22, the latter being supported by a couple of idle rollers 23 borne by the bedplate 1.

Above the articles to be packaged, conversely, a top sheet 24 is fed, and its feed is controlled by a feed unit generally indicated at 25.

The feed unit 25 has as its starting member the payoff drum 26 which is borne and actuated by two rollers 27 which are connected to a motor 28 by a chain 43, whereas its output member is a motorized feeding roller 29 which is enabled to coact with a pressure roller 30: the latter is borne for free rotation by a lever 31 pivoted at 32, which is controlled by a pneumatic ram 33. Between the drum 26 and the roller 29 (feeder) a set of idle rollers 34–38 is inserted and these compel the top sheet 24 to form an alternate series of loops. Two of such idle rollers, and more exactly those indicated at 35 and 37, are supported by respective levers, 39 and 40, pivoted at 41, the former lever acting by mere gravity pull whereas the second lever is controlled by a pneumatic ram 42.

The machine shown in the drawings further comprises a presser 44 (which is provided for only if the kind of article such as 20 so permits or requires) and a welding unit 45, which are supported by the carriage 11 in a vertically shiftable manner all along guideways 46 and 47. More specifically, the welding unit 45 can be depressed from the lifted position of FIG. 1 to the position of engagement with a counterwelding unit 48 (FIG. 3), the latter being borne beneath the bottom sheet 21 in the belt deflection zone which is defined by the rollers 7, 8 and 9 for the belt 10. Bell-crank levers 51 and 52, pivoted at 53 and 54 and actuated by pneumatic rams 55 and 56, provide, via pitmans 49 and 50, to control the displacements of the presser 44 and the welding unit 45.

The conveyor belt 10 is forerun by a feeding belt 57 which is equipped with appropriate motive means not shown in the drawings.

Lastly, a set of photoelectric cells, 58, 59 and microswitches 60, 61 are provided, the tasks of which will be indicated hereinafter in connection with the description of the operation of the machine illustrated herein.

To have a fair understanding of the operation of the machine, let it be assumed that the machine is in the condition shown in FIG. 1 with the conveyor 10 at standstill and three articles 20 (for example consisting of packages of sundry articles) marshalled one behind the next on the top lap (i.e. horizontal) of the conveyor 10, the first article being already wrapped between the two juxtaposed sheets 21 and 24, the second article being partially tucked between the two sheets, and the third article merely laid on the bottom sheet 21. Also the carriage 11 is stationary and so are the presser 44 and the welding unit 45. Also the feeding unit 25 is at standstill. Only the conveyor belt 57 is running and feeds further articles 20 towards the conveyor belt 10.

As soon as the first of such further articles reaches the photoelectric cell 58 (FIG. 2), the motor 15 energizes the conveyor 10 and simultaneously starts the displacement of the carriage 11 from the right to the left as viewed in the drawings. Moreover, the ram 33 causes the pressure roller 30 to move away from the feeding roller 29 and the ram 42 commands the lever 40 to be lifted and thus the idle roller 37 is likewise lifted and originates a free sheet portion. Lastly, the rams 55 and 56 command the presser 44 and the welding unit 45 to be lowered.

While the presser 44 rests on the top of the underlying article 20, the welding unit 45 abuts the top sheet 24 and, when going down towards the counterwelding unit 48, draws in a span, as long as it is necessary, nothing more and nothing less, of the sheet portion which was left free between the rollers 36 and 38. Such a span is closely proportional to the tallness of the article which is being packaged;

As the welding unit 45 reaches the counterwelding unit 48, the microswitch 60 is activated which in turn acts upon the rams 33 and 42 and upon the feed roller 29 so as to cause the presser roller 30 to engage the feed roller 29 again, concurrently with the rotation of 29 and the slow fall of the lever 40 again and then that of the idle roller 37 (FIG. 3) to exert a withdrawing pull on the top sheet.

As a result, the sheet span between the two rollers 34 and 36 which forerun and follow the roller 35 becomes shortened and thus the roller 25 is lifted: the lever 39 of 35 clears the microswitch 61. The latter then energizes the motor 28 to command a payoff of sheet from the drum 26 until restoring the condition of FIG. 1 once more, that is, with the roller 35 and 37 both depressed.

Figure 4:
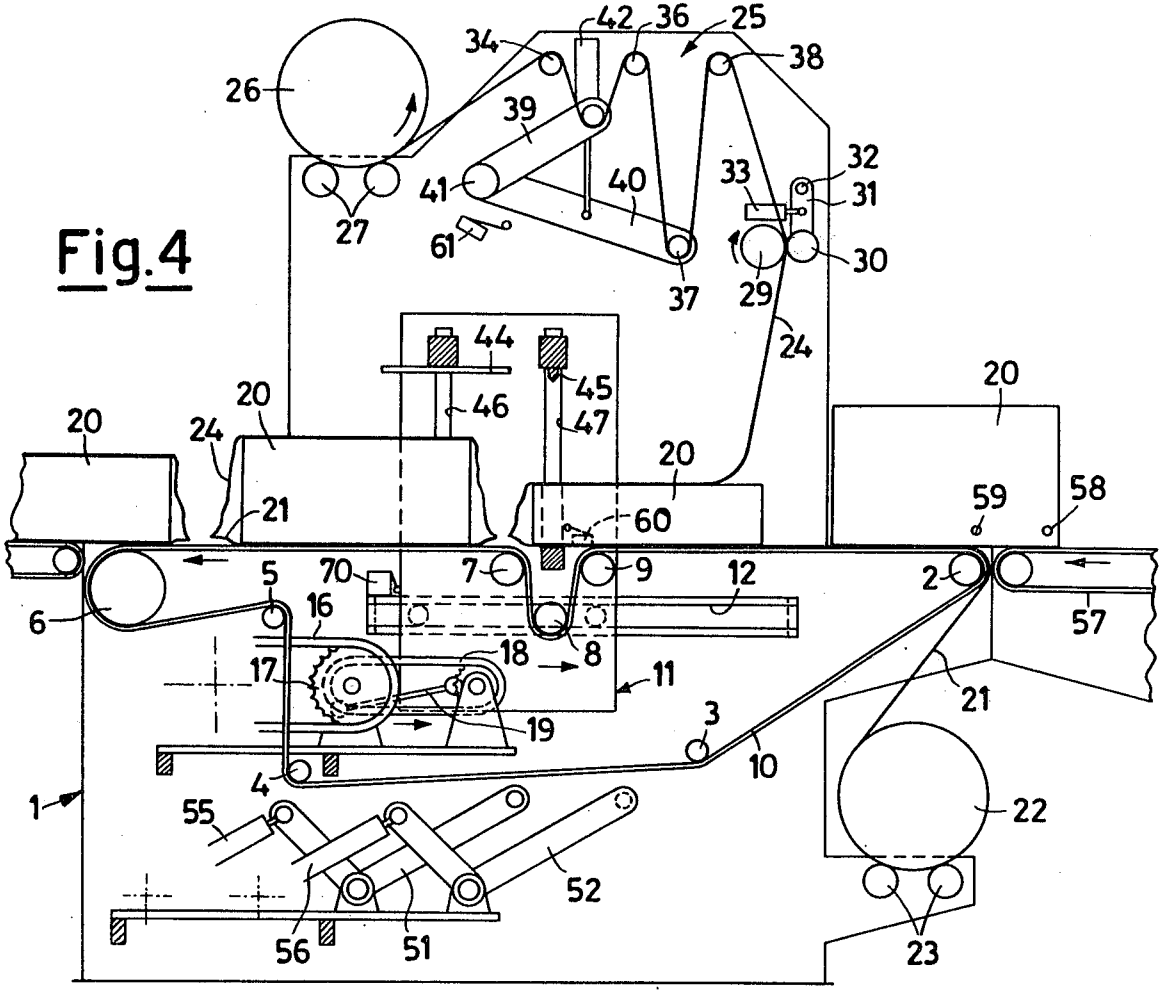

Meanwhile, upon performing the conventional double transversal welding and intermediate severing action between the two seams and while the carriage 11 has continued its stroke forward, the welding unit 45 and the presser 44 have been commanded by another abutment 70 (FIG. 3) contacted by the carriage 11, to be lifted once again and the carriage has meanwhile provided to reverse its motion and to go back to its starting position (FIG. 4).

When the article which was initially supported by the conveyor 57 has reached and then left the photoelectric cell 59, thus attaining the position as initially occupied by the third article in the row, the conveyor belt 10 lastly stops and the feed roller 29 is concurrently stopped.

Figure 5:
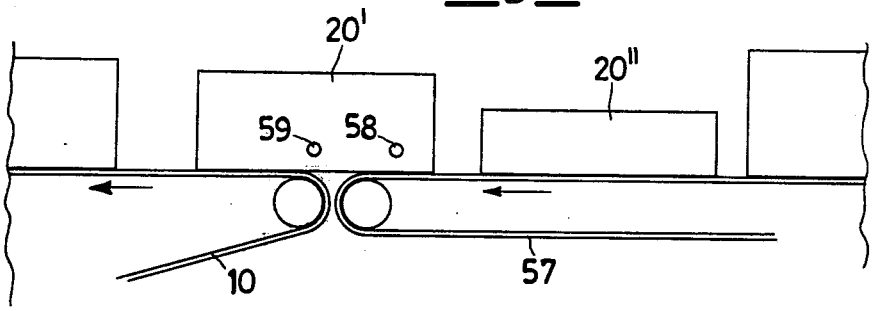

It should be noted that, if the articles 20 have been positioned on the feed belt 57 at a distance from each other which is shorter than that which is required for the welding zone, the photoelectric cells 58 and 59 provide to have them properly spaced apart from each other and makes possible, if so desired, a continuous machine operation. This can be seen in FIGS. 5 to 7, the first of which shows the conveyors 10 and 57 both in movement with a first article 20' when it is being transferred from the conveyor 57 to the conveyor 10.

Figure 6:
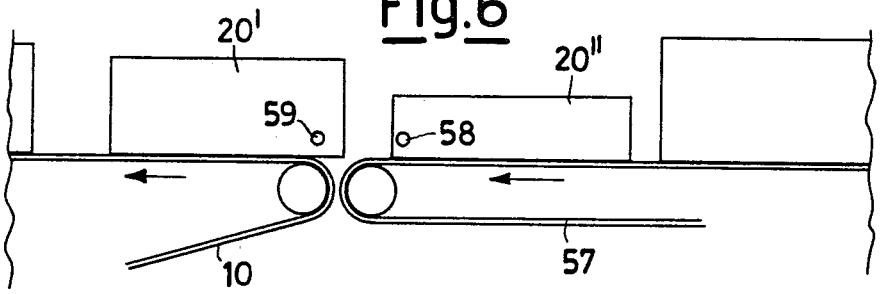

In FIG. 6, the article 20', after having cleared the photoelectric cell 58, has been transferred onto the conveyor 10 while keeping the photoelectric cell 59 masked, and the article 20'' has masked the photoelectric cell 58 thus causing the stoppage of the conveyor 57.

Figure 7:
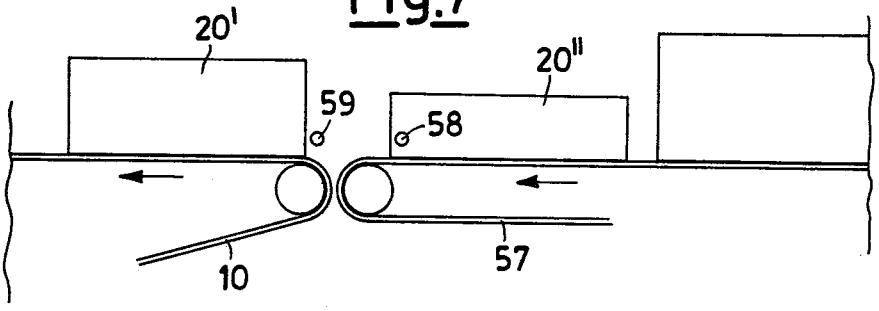

In FIG. 7, lastly, the article 20' has cleared the photoelectric cell 59 and permitted the restarting of the conveyor 57, thus correctly defining the distance between the articles 20' and 20'' without stopping the conveyor 10.

We claim:

1. A machine for packaging sundry articles between juxtaposed sheets of a plastics material, comprising a conveyor belt movable along a working path of horizontal orientation for carrying a bottom sheet fed on said conveyor belt along said working path to receive the articles to be packaged, means for feeding a top sheet above the article to be packaged along said working path and a welding unit situated above the top sheet and capable of being lowered until engaging a counterwelding unit positioned beneath the bottom sheet to perform a double-seam welding transversally of the sheets with a severing cut therebetween, at every interval between an article and its next, characterized in that for the feed of the top sheet there is provided a feeding unit including a payoff drum, means for controllably driving said drum, a feeding roller, means for controllably driving said feeding roller, a pressure roller, means for moving said pressure roller toward and away from said feeding roller so as to selectively clamp and release the top sheet, a succession of idle rollers inserted between said drum and said feeding roller to provide a series of alternate sheet loops in said top sheet, means for shifting at least one of said idler rollers relative to the adjoining rollers and in a direction away from the top sheet to define a freed sheet span, said succession of rollers including an additional roller yieldably urged toward a normal working position which is adapted to form a sheet loop and which is withdrawable from its normal working position as a consequence of a pull exerted on the top sheet, means for lowering and raising said welding unit toward and away from said counterwelding unit, and a control system including first means responsive to the arrangement of the articles to be packaged in a preselected position for actuating (a) the withdrawal of said pressure roller from said feeding roller so as to release the top sheet from said feeding roller whereby the sheet span is freely withdrawable by said welding unit whenever said unit drops toward said counterwelding unit, (b) the shift of said at least one idler roller in a mode to provide the freed sheet span and (c) lowering of said welding unit toward said counterwelding unit, second means responsive to the attainment of engagement between said welding unit and said counterwelding unit for subsequently actuating (a) engagement of said pressure roller with said feeding roller, (b) driving of the latter and (c) gradual shifting of said at least one idler roller in an opposite mode toward the sheet and into contact with the sheet to exert a withdrawing pull on the top sheet so that subsequent movement of said roller away from the freed sheet will form a sheet span, and third means for actuating said drum in a sheet payoff direction in response to the shift of said additional idler roller from its normal working position as a consequence of said gradual shifting of said at least one roller in said opposite mode and the actuation of the driving of the feeding roller.

* * * * *